US008276297B2

(12) United States Patent
Fabrikant

(10) Patent No.: US 8,276,297 B2
(45) Date of Patent: Oct. 2, 2012

(54) CLOTHES STEAM IRONING APPARATUS

(76) Inventor: Jordan Fabrikant, El Cajon, CA (US)

( * ) Notice: Subject to any disclaimer, the term of this patent is extended or adjusted under 35 U.S.C. 154(b) by 314 days.

(21) Appl. No.: 12/562,205

(22) Filed: Sep. 18, 2009

(65) Prior Publication Data

US 2010/0199528 A1 Aug. 12, 2010

Related U.S. Application Data

(60) Provisional application No. 61/152,116, filed on Feb. 12, 2009.

(51) Int. Cl.
*D06F 71/34* (2006.01)
*D06F 71/36* (2006.01)

(52) U.S. Cl. ..... 38/15; 38/71

(58) Field of Classification Search ..... 38/12–17, 38/25–43, 77.82, 88, 76, 93, 97, 71
See application file for complete search history.

(56) References Cited

U.S. PATENT DOCUMENTS 984,673 A * 2/1911 House ..... 38/71
3,068,598 A * 12/1962 Johnston ..... 38/71
3,703,042 A * 11/1972 Smith ..... 38/69
4,219,724 A 8/1980 Allvin
4,817,309 A 4/1989 Frank et al.
4,848,868 A 7/1989 Tierney et al.
6,173,718 B1 * 1/2001 Okumoto et al. ..... 132/224
7,121,024 B1 10/2006 Clevenberg
7,188,442 B2 3/2007 Fernandez
7,380,556 B2 6/2008 Carballada et al.
2010/0018084 A1 * 1/2010 Segrete ..... 38/71

* cited by examiner

*Primary Examiner* — Ismael Izaguirre
(74) *Attorney, Agent, or Firm* — Allen Trim

(57) ABSTRACT

A hand-held clothes steam ironing apparatus includes first and second elongated substantially rectangular arm members having an inner portion and an outer portion, a hinge mechanism rotatably connecting the two arm members at one narrow end of each such that said inner portions are substantially opposing. Imbedded in inner portions of each arm members is at least one heat plate, this heat plates containing a plurality of steam orifices distributed longitudinally along the heat plate with fluid communication between the orifices. An electrical power supply is wired in adjacent the hinge mechanism and electrically connects to the heat plates with power control capability between the two for regulating the amount of power supplied to the heat plates. Water tanks with removable caps are attached to outer portions of each of the body members, and water conduits run between each water tank and the heat plates in the corresponding arm members.

8 Claims, 6 Drawing Sheets

CLOTHES STEAM IRONING APPARATUS

CROSS REFERENCE TO RELATED APPLICATION

This patent application is related to and claims priority from U.S. Provisional Patent Application Ser. No. 61/152,116 filed Feb. 12, 2009.

FIELD OF THE INVENTION

The present invention relates, in general, to hand-held clothes pressing devices and, more particularly, this invention relates to two-sided clothes pressing and steaming.

BACKGROUND OF THE INVENTION

Prior to the conception and development of the present invention, those wishing to press wrinkles out of clothing have typically used a one-sided iron in combination with an ironing board. It is common now for these irons to optionally produce steam as well as heat. Removal of wrinkles from clothing is also accomplished sometimes with a steamer that generates steam and directs it up against the fabric of a hanging clothing item. The steamer applies no pressure to the clothing; hence, the fabric is not as smooth as it would be by ironing with pressure, steam, and heat.

Allvin in U.S. Pat. No. 4,219,724 teaches a hand tool for pressing garments that has triangular-shaped jaws, only one of which is heated, and there is not steam. Frank et al in U.S. Pat. No. 4,817,309 teaches a hand-held steam press consisting of two opposing short press plates from which steam can emanate, but there appears to be no heat supplied other than by the steam. Clevenberg in U.S. Pat. No. 7,121,024 discloses a two member hand-held clothing presser which may have heating plates on one or both or the two members that are hinged at one end.

Carballada et al in U.S. Pat. No. 7,380,556 teaches the electrical elements for a hair straightener that produces steam and heat, but only on one arm of the apparatus provides steam. A common shortcoming of all this prior art is the relatively narrow path that these devices smooth as they are drawn across a larger clothing item such as a shirt. Making the arm members longer may seem like an answer to that, but another problem this creates is additional drag as more surface area of cloth is pinched between the two arm members. Clevenberg refers to this problem in column 17, line 35 by referring to the need to limit the clamping force so that it "is not so tight as to prevent moving the dual iron device 10 along the fabric 48". This drag becomes even more of a problem if the heat plates of the ironing device are not exactly parallel to the cloth surface as the ironing device is pulled along it.

SUMMARY OF THE INVENTION

The present invention provides a hand-held clothes steam ironing apparatus including first and second elongated substantially rectangular arm members having an inner portion and an outer portion, a hinge mechanism rotatably connecting the two arm members at one narrow end of each such that said inner surfaces are substantially opposing. Imbedded in inner portions of each arm members is at least one heat plate, this heat plates containing a plurality of steam orifices distributed longitudinally along the heat plate with fluid communication between the orifices. An electrical power supply is wired in adjacent the hinge mechanism and electrically connects to the heat plates with power control capability between the two for regulating the amount of power supplied to the heat plates. Water tanks with removable caps are attached to outer portions of each of the arm members, and water conduits run between each water tank and the heat plates in the corresponding body members.

In a preferred embodiment of the present invention, each heat plate further contains an elongated rolling pin rotatably imbedded longitudinally and slightly protruding above the top surface of the heat plates. In another embodiment, the heat plates are simply flat and fixed within the arm members with a multiplicity of steam orifices spread over the heat plates.

OBJECTS OF THE INVENTION

It is, therefore, one of the primary objects of the present invention to provide an effective compact clothes-pressing steam iron which requires no ironing surface to press against.

Another object of the present invention is to provide a hand-held clothes-pressing apparatus which employs heat, steam, and pressure to smooth clothing items hung in a vertical position.

Still another object of the present invention is to provide a more effective hand-held apparatus for removing wrinkles from clothing quickly from relatively large fabric areas with minimal effort.

Yet another object of the present invention is to provide a clothing pressing apparatus which delivers both steam and heat to two sides of the clothing items simultaneously.

An additional object of the present invention is to provide a dual arm hand-held steam pressing apparatus for clothing which can be drawn across and smooth a large area of clothing with minimal frictional drag from pinching the fabric.

In addition to the various objects and advantages of the present invention described with some degree of specificity above, it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
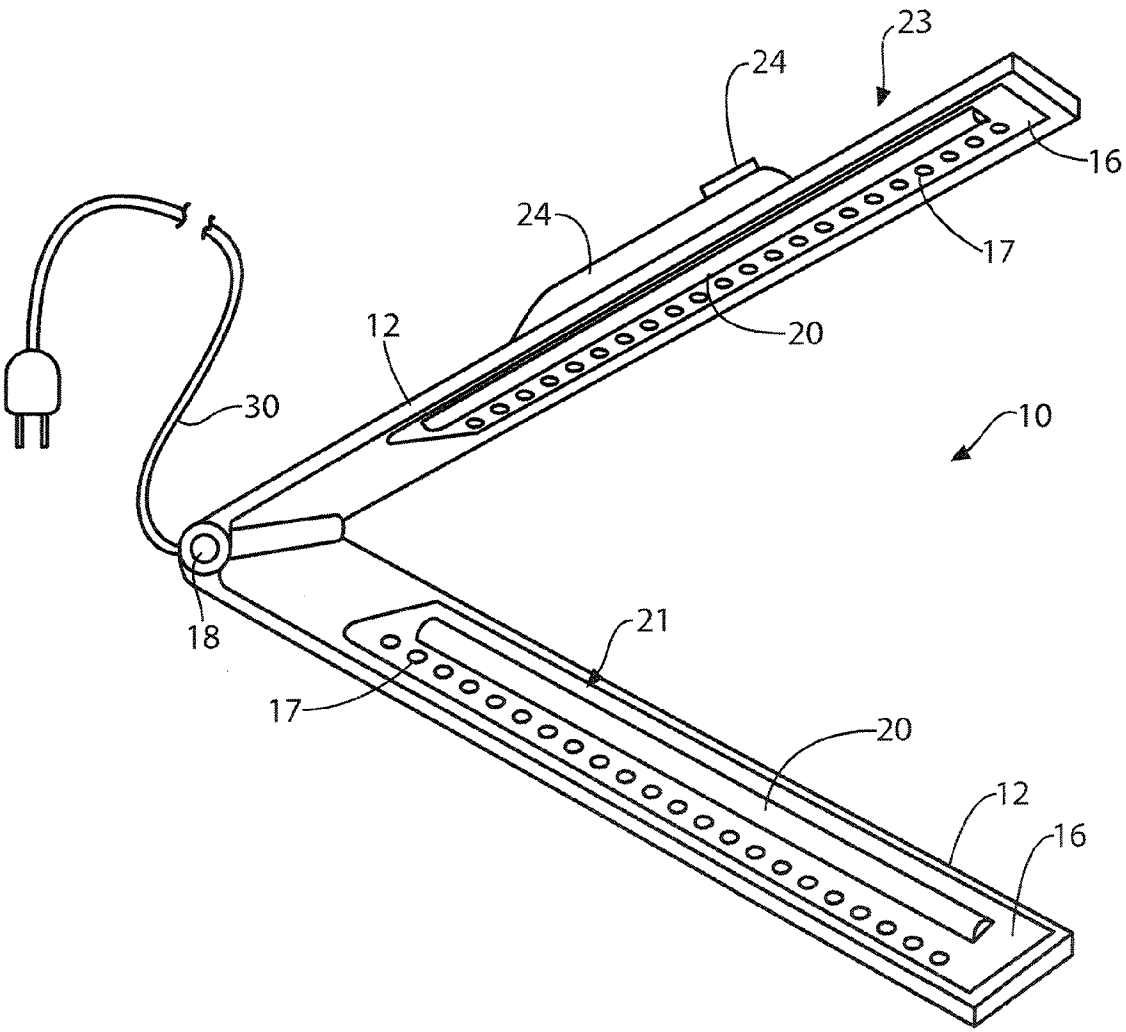
FIG. 1 is a perspective view of a preferred embodiment of the present invention.

DETAILED DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Referring initially to FIG. 1, a preferred embodiment of the present invention is presented, generally shown as 10. The two elongated arm members 12 are connected at one end with a spring/hinge member 18, somewhat like a hair straightener is constructed such that the spring/hinge mechanism 18 separates the arms 12 significantly at the distal ends but allows the two to pinch together readily with mild pressure on the arms 12. The spring/hinge mechanism 18 is typically a torsion spring with end prongs wrapped around a pin, but it is not limited to this type. The elongated arm members 12 each have an inner portion 21, which face each other. The outer portion 23 covers insulation and internal electrical parts, and also holds the water tanks 24. The elongated arm members 12 are typically 8 to 18 inches in length, with about 12 inches being preferable. A standard 110-volt power cord 30 is attached adjacent the spring/hinge mechanism 18. Each elongated arm member 12 has embedded electric heat plates 16, with about a two to six inch gap between the spring/hinge mechanism 18 and the proximal end of the heat plate. Preferably each heat plate 16 is one long piece, but it can also be in sections of two or more. Extending axially within each heat plate 16 is a roller rod 20. This roller rod protrudes only about 1 to 5 millimeters above the surface of the heated plate 16. The roller rod 20 and heat plates 16 can optionally be coated with a non-stick fluoro-polymer (Teflon©) coating. Along and through each heat plate 16 is at least one row of steam orifices 17. The orifices 17 and roller rod 20 on one arm member 12 oppose the roller rods 20 and orifices 17 respectively on the other arm member. On the non-heated outer portion 23 of each arm member, there is a water tank 22 with a filler port 24. Prior to use, the water tanks 22 are filled, the dual arm clothes ironer is plugged in and turned on. When warmed up, a wrinkled clothing item is clamped between the heat plates 16 by hand pressure, and then pulled or pushed along gradually with the rolling pins 20 facilitating the movement while steam and heat combine to get rid of the wrinkles.

Figure 2:
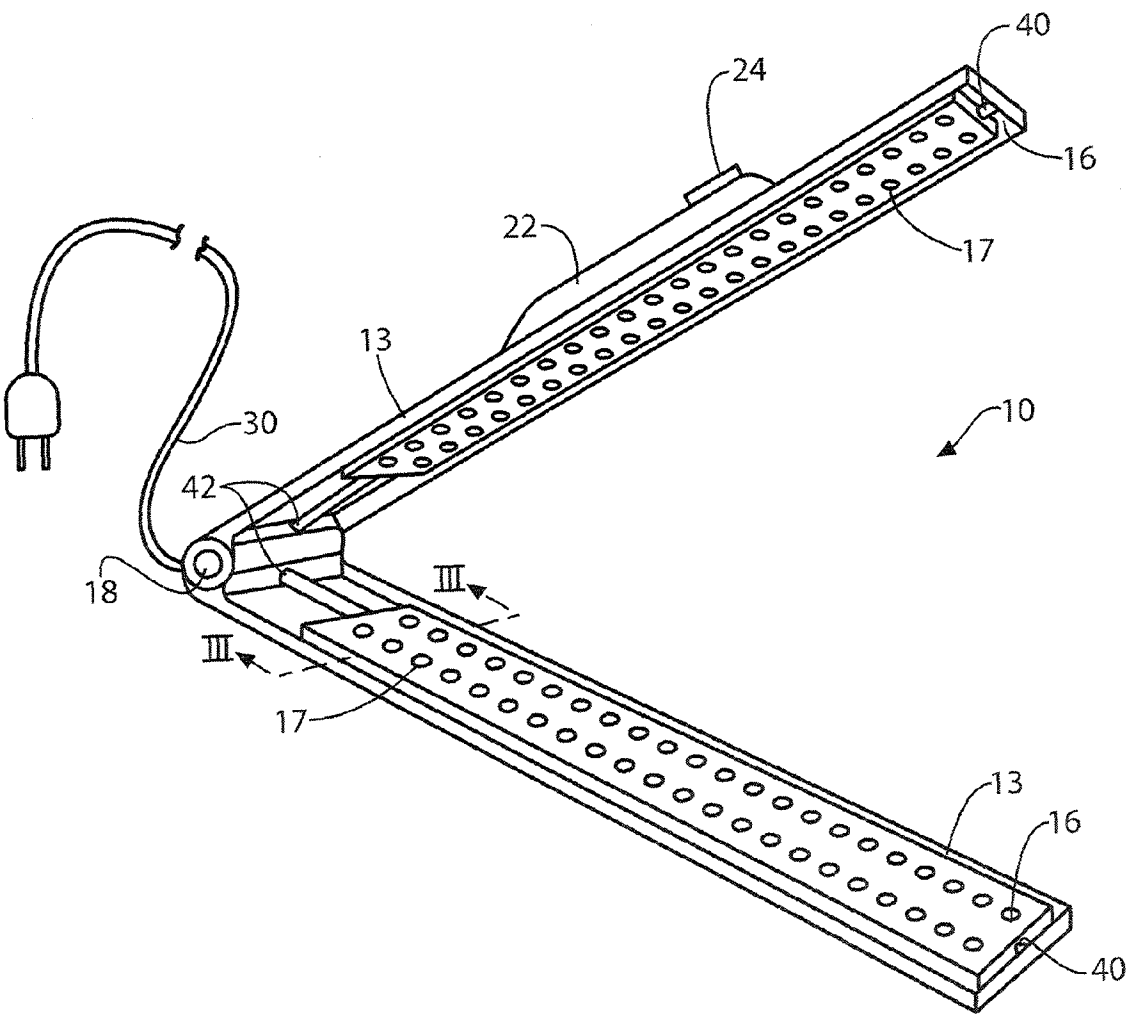
FIG. 2 provides a perspective view of a second embodiment of the present invention with tilting plates.
Figure 3:
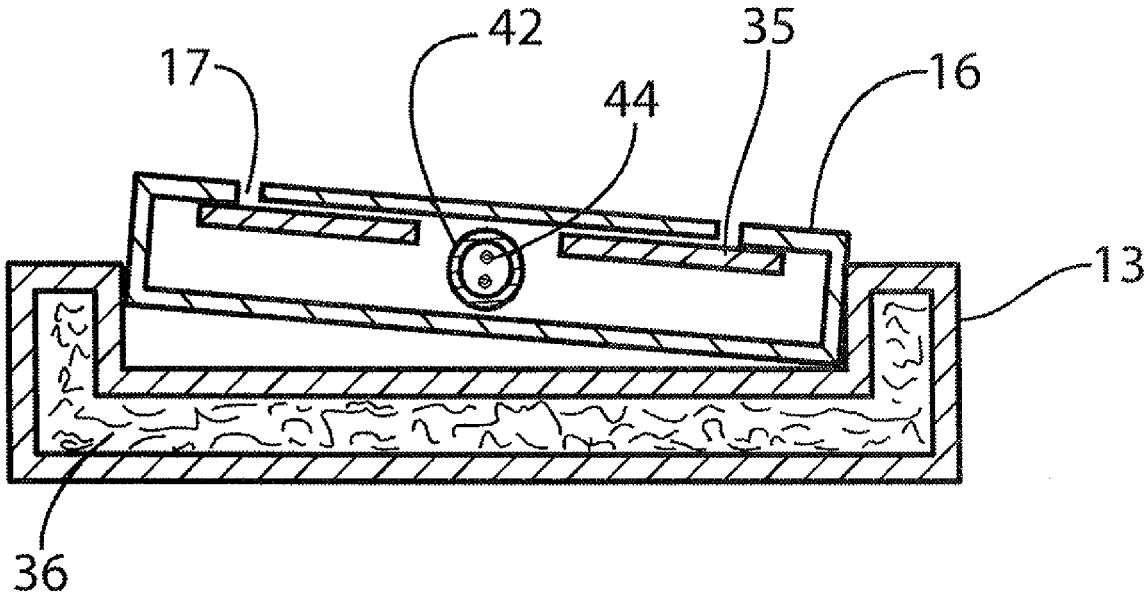
FIG. 3 is an end cross sectional view of the present invention as depicted in FIG. 2.

FIG. 2 provides a perspective view of a second embodiment of the present invention with tilting heat plates 16. Within the elongated body members 12, the heat plates 16 are supported at each end with axial axle tubes 40 and 42 which extend the length of the heat plates 16, and which allow limited tilting of the plates 16 from side to side. The axle tube 42 at the end proximal the spring/hinge mechanism 18 and power cord 30 is hollow inside to permit flow of water or steam and provide a conduit for the power wires. Each heat plate 16 has at least one row of steam orifices 17 to allow steam out much like any conventional steam iron. Each body member 13 has a small water tank 22 on the outer side with a fill port and cap 24. FIG. 3 provides additional details of this second embodiment in a cross sectional view near the hinge member 18. The body member 13 has a substantially hollow interior partially filled with insulation 36. Power wires 44 pass through the hollow axle tube 42, as does water as needed. The heat plates 16 have resistance heating elements 35 underneath to heat the plate surfaces and also to produce steam which emanates from orifices 17 when the heat is turned on. Alternatively, steam can be generated at the water tank and conveyed through the hollow axle tube 42. The wiring from the power wires 44 out to the resistance heating elements 35 is not shown in this cross sectional view.

Figure 4:
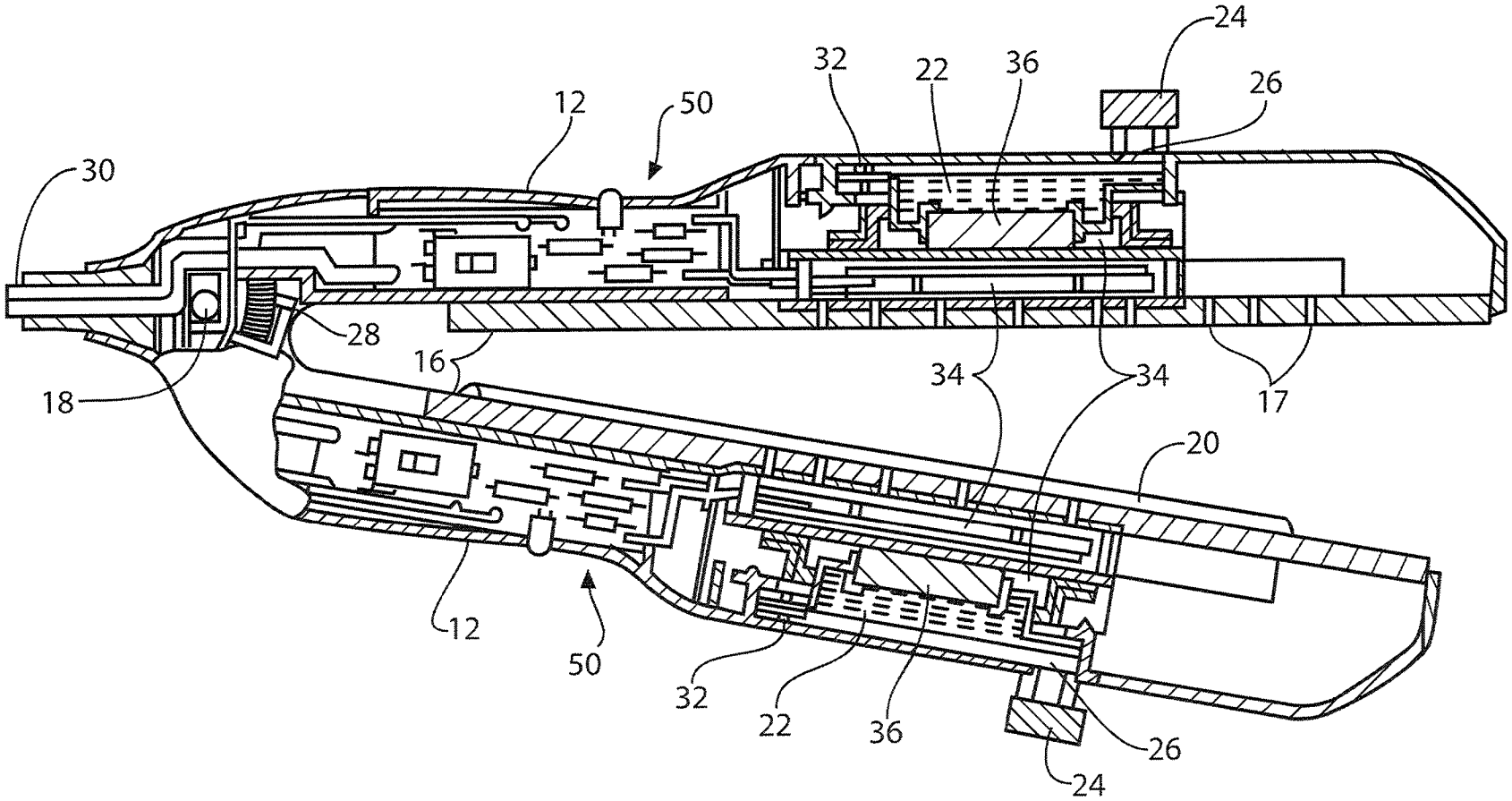
FIG. 4 is a cross sectional side view of the present invention as depicted in FIG. 1.

FIG. 4 is a cross sectional side view of the present invention as depicted in FIG. 1 and providing details of the interior not visible from the exterior views. The top and bottom arm members 12 are essentially the same except that the roller pin 20 on one half is directly opposite the steam orifices 17 on the opposing half. Only one of the roller pins 20 is shown in this view. The heat plates 16 extend nearly the whole length of each arm member 12, but the roller pin 20 and steam orifices 17 may or may not extend the same distance. Power enters via supply cord 30, and splits to each half. The internal circuitry and switches 50 allow regulation of the heating and steam production. This portion 50 is very much like that taught by Carballada et al in U.S. Pat. No. 7,380,556 which teaches a portion of the technology employed, but just for one half, and which is hereby incorporated by reference for both halves of the present invention. One alternative configuration of the hinge/spring combination is also illustrated with 18 being the hinge pin and 28 pointing to the spring.

Figure 5:
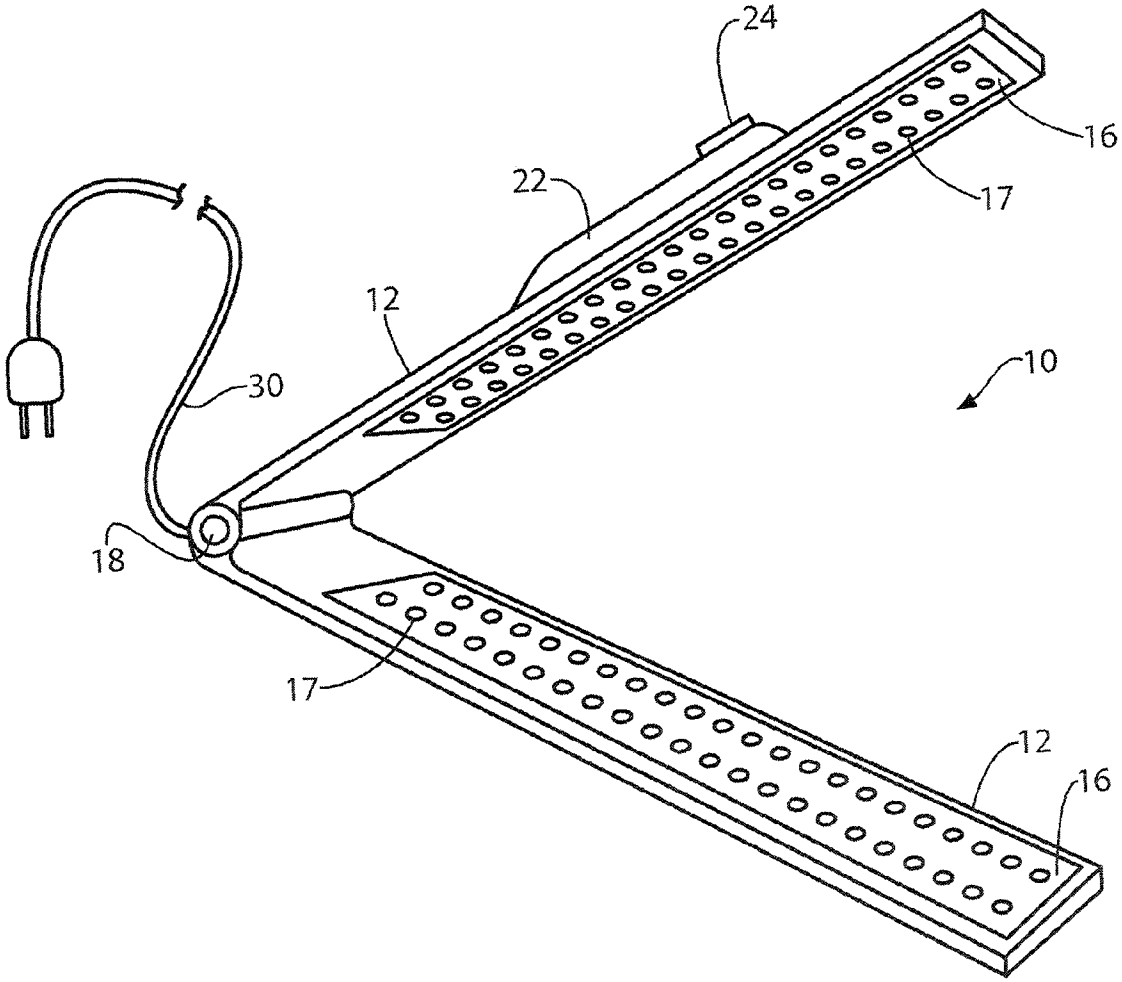
FIG. 5 provides a perspective view of a third embodiment of the present invention.

FIG. 5 is a perspective view of a third embodiment of the present invention, generally shown as 10. There are two elongated arm members 12, each having a low-profile water tank 22 with a filler port and cap 24. The arm members 12 are joined at one end with a spring/hinge assembly 18, which keeps the heat plates 16 separated until hand pressure is applied to clamp the fabric to be ironed. Each arm member 12 has a substantially flat and fixed electrically heated plate 16 with a multiplicity of steam orifices 17. Electrical power enters via power cord 30.

Figure 6:
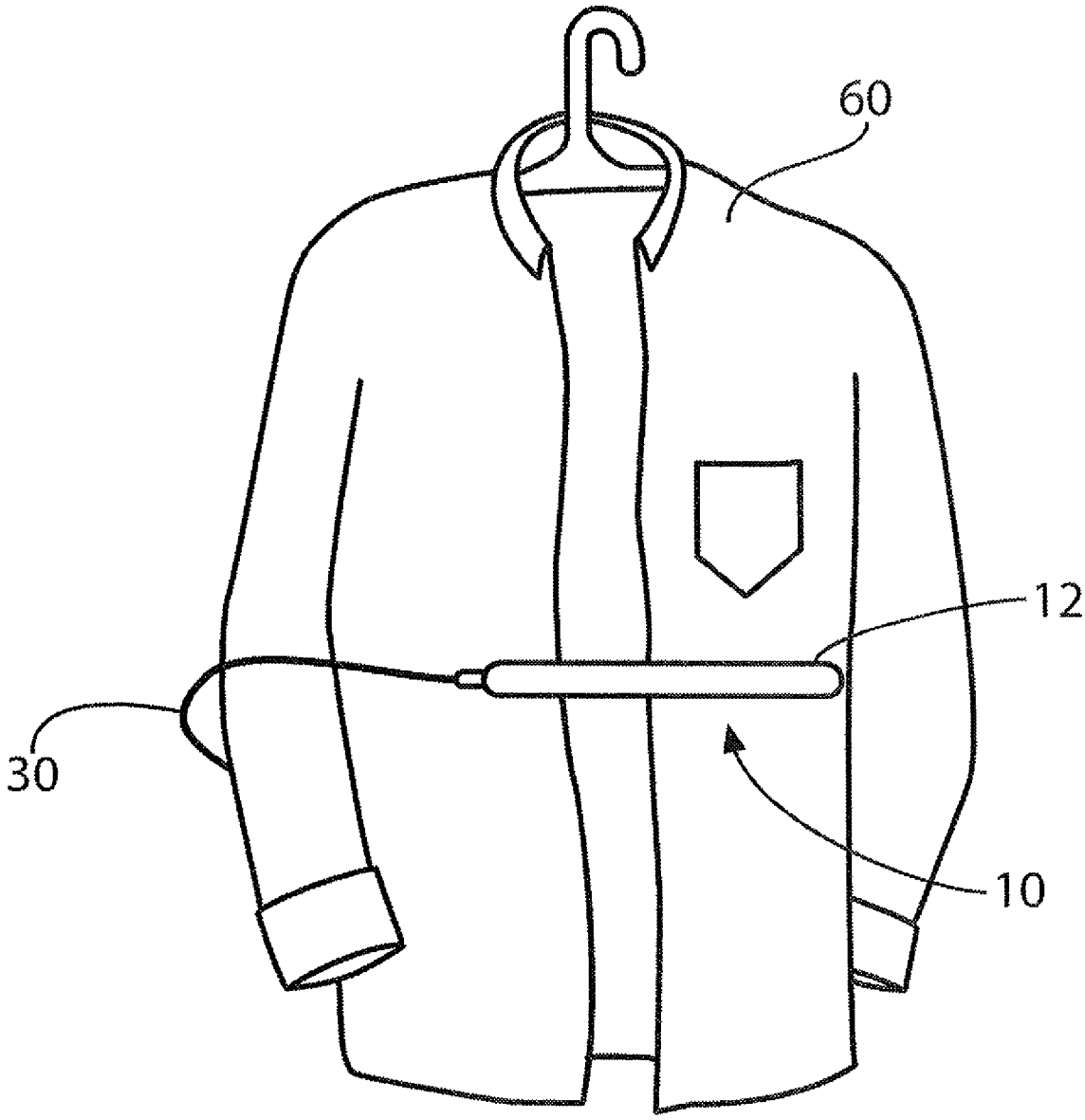
FIG. 6 provides an elevation view illustrating use of the present invention.

FIG. 6 provides an illustrative view of the present invention apparatus 10 in use. When power cord 30 is plugged in, and the heat plates of the apparatus 10 have warmed up, a wrinkled clothing item 60 is clamped between the arms 12, one on each side of the area of item 60, by hand pressure, and then pulled or pushed along gradually while steam and heat combine to get rid of the wrinkles. In the first embodiment, the rolling pins facilitate the movement of the dual arm ironing apparatus 10 along and over the fabric. With the alternative embodiment represented by FIG. 2, the tilting plates allow the ironing apparatus 10 to be held by the user in a comfortable position without excessive bending of the fabric.

While a presently preferred and various alternative embodiments of the present invention have been described in sufficient detail above to enable a person skilled in the relevant art to make and use the same, it should be obvious that various other adaptations and modifications can be envisioned by those persons skilled in such art without departing from either the spirit of the invention or the scope of the appended claims.

What is claimed is:

1. A hand-held clothes steam ironing apparatus comprising:

a) a first elongated substantially rectangular body member of a first predetermined length having an inner portion and an outer portion;

b) a second elongated substantially rectangular body member of a second predetermined length having an inner portion and an outer portion;

c) a hinge means disposed at a narrow end of said first rectangular body member and rotatably connecting to a narrow end of said second rectangular body such that said inner portions are substantially opposing;

d) at least one heat plate imbedded in each of said inner portions of said first and second elongated body members, said heat plates having an exposed surface disposed over a predetermined portion of said inner portion, and wherein each of said heat plates further include a rotatable elongated longitudinal roller rod protruding between about one and five millimeters above said exposed surface of said heat plates;

e) a plurality of steam orifices distributed longitudinally along said heat plate with fluid communication between said orifices;

f) an electrical power supply cord disposed adjacent said hinge means and electrically connected to said heat plates;

g) a power control means disposed between said power supply and said heat plates for regulating the amount of power supplied to said heat plates;

h) a water tank with removable cap attached to said outer portions of each of said body members; and i) water conduits disposed between each said water tank and said heat plates in corresponding body member.

2. The hand-held clothes steam ironing apparatus, according to claim 1, wherein said first predetermined length of said first elongated body member is between about 8 and 18 inches.

3. The hand-held clothes steam ironing apparatus, according to claim 1, wherein said second predetermined length of said second elongated body member is substantially equal to that of said first predetermined length.

4. A hand-held clothes steam ironing apparatus comprising:

a) a first elongated substantially rectangular body member of a first predetermined length having an inner portion and an outer portion;

b) a second elongated substantially rectangular body member of a second predetermined length having an inner portion and an outer portion;

c) a hinge means disposed at a narrow end of said first rectangular body member and rotatably connecting to a narrow end of said second rectangular body such that said inner portions are substantially opposing;

d) an elongated heat plate with axial axle tubes rotatably disposed in each of said inner portions of said body members, said heat plates having an exposed surface disposed over a predetermined portion of said inner portion;

e) a plurality of steam orifices distributed longitudinally along said exposed surface of said elongated heating plate with fluid communication between said orifices and said axial axle tube;

f) an electrical power supply cord disposed adjacent said hinge means and electrically connected to said heat plates;

g) a power control means disposed between said power supply and said heat plates for regulating the amount of power supplied to said heat plates;

h) a water tank with removable cap attached to said outer portions of each of said body members; and i) conduits disposed between each said water tank and said heat plates in corresponding body member for conveying one of water and steam to said heat plates.

5. The hand-held clothes steam ironing apparatus, according to claim 4, wherein said first predetermined length of said first elongated body member is between about 8 and 18 inches.

6. The hand-held clothes steam ironing apparatus, according to claim 4, wherein said second predetermined length of said second elongated body member is substantially equal to that of said first predetermined length.

7. The hand-held clothes steam ironing apparatus, according to claim 4, wherein said water tank further includes an electrical heating element for steam generation.

8. A hand-held clothes steam ironing apparatus comprising:

a) a first elongated substantially rectangular body member of a first predetermined length having an inner portion and an outer portion;

b) a second elongated substantially rectangular body member of a second predetermined length having an inner portion and an outer portion;

c) a hinge means disposed at a narrow end of said first rectangular body member and rotatably connecting to a narrow end of said second rectangular body such that said inner portions are substantially opposing;

d) heat plates imbedded in each of said inner portions of said first and second elongated body members, said heat plates having an exposed surface extending along substantially all of said first and second predetermined lengths;

e) a plurality of steam orifices distributed longitudinally along said heat plate with fluid communication between said orifices;

f) an electrical power supply cord disposed adjacent said hinge means and electrically connected to said heat plates;

g) a power control means disposed between said power supply and said heat plates for regulating the amount of power supplied to said heat plates;

h) a water tank with removable cap attached to said outer portions of each of said body members; and i) water conduits disposed between each said water tank and said heat plates in corresponding body member.

* * * * *